US006402674B1

(12) United States Patent
Simmons, Jr. et al.

(10) Patent No.: US 6,402,674 B1
(45) Date of Patent: Jun. 11, 2002

(54) CUSHIONING CONVERSION SYSTEM AND METHOD WITH DANCER ROLLER CART

(75) Inventors: James A. Simmons, Jr., Painesville Township; Richard O. Ratzel, Westlake, both of OH (US)

(73) Assignee: Ranpak Corp., Concord Township, OH (US)

( * ) Notice: Subject to any disclaimer, the term of this patent is extended or adjusted under 35 U.S.C. 154(b) by 0 days.

(21) Appl. No.: 09/218,910

(22) Filed: Dec. 22, 1998

Related U.S. Application Data

(60) Provisional application No. 60/068,606, filed on Dec. 23, 1997.

(51) Int. Cl.[7] ..... B31B 1/00

(52) U.S. Cl. ..... 493/24; 493/464; 493/967

(58) Field of Search ..... 242/413, 412.1, 242/416; 493/24, 967, 464

(56) References Cited

U.S. PATENT DOCUMENTS

| | | | | |
|---|---|---|---|---|
| 3,971,695 A | * | 7/1976 | Block | |
| 4,040,043 A | * | 8/1977 | Stanford | 53/389.2 |
| 4,341,586 A | * | 7/1982 | Koutonen | 53/389.2 |
| 4,557,716 A | | 12/1985 | Ottaviano | |
| 4,619,635 A | | 10/1986 | Ottaviano | |
| 4,650,456 A | | 3/1987 | Armington | |
| 4,690,344 A | | 9/1987 | Yokota | |
| 4,807,423 A | * | 2/1989 | Schnippering et al. | 53/389.2 |
| 5,016,182 A | | 5/1991 | Bergland et al. | |
| 5,033,250 A | * | 7/1991 | Josefek et al. | 53/389.1 |
| 5,123,889 A | | 6/1992 | Armington et al. | |
| 5,317,858 A | * | 6/1994 | Hanai | 53/389.2 |
| 5,571,067 A | | 11/1996 | Ratzel | |
| 5,637,071 A | | 6/1997 | Simmons et al. | |
| 5,713,825 A | * | 2/1998 | Ratzel | 493/464 |

FOREIGN PATENT DOCUMENTS

| | | | | |
|---|---|---|---|---|
| DE | 4037097 | * | 5/1992 | 493/24 |
| WO | WO96/40493 | | 12/1996 | |
| WO | WO97/01434 | | 1/1997 | |

* cited by examiner

*Primary Examiner*—Eugene Kim
(74) *Attorney, Agent, or Firm*—Renner, Otto, Boisselle & Sklar, LLP

(57) ABSTRACT

A cushioning conversion system including a cushioning conversion machine having conversion assemblies for converting a sheet stock material into a relatively lower density cushioning dunnage product, a stand for supporting the cushioning conversion machine at a convenient height and/or angular orientation, and a stock supply cart including a dancer roller for helping to maintain a greater uniformity of tension on the sheet material being fed through the conversion assemblies from changes in loads acting on the sheet material upstream of the dancer roller regardless of the angular orientation of the cushioning conversion machine.

30 Claims, 7 Drawing Sheets

CUSHIONING CONVERSION SYSTEM AND METHOD WITH DANCER ROLLER CART

RELATED APPLICATIONS

This application claims the benefit of U.S. Provisional Application No. 60/068,606, filed Dec. 23, 1997.

FIELD OF THE INVENTION

The invention herein described relates generally to a cushioning conversion system and method and, more particularly, to improvements in the mechanisms for feeding sheet stock material into such systems for conversion into a dunnage product.

BACKGROUND OF THE INVENTION

In the process of shipping an item from one location to another, protective packaging material is often placed in the shipping container to fill any voids and/or to cushion the item during the shipping process. Some commonly used protective packaging materials are plastic foam peanuts and plastic bubble pack. While these conventional plastic materials seem to perform adequately as cushioning products, they are not without disadvantages. Perhaps the most serious drawback of plastic bubble wrap and plastic foam peanuts is their effect on our environment. Quite simply, these plastic packaging materials are not biodegradable, and therefore they cannot avoid further multiplying our planet's already critical waste disposal problems. The nonbiodegradability of these packaging materials has become increasingly important in light of many industries adopting more progressive policies in terms of environmental responsibility.

The foregoing and other disadvantages of conventional plastic packaging materials have made paper protective packaging material a popular alternative. Paper is biodegradable, recyclable and composed of a renewable resource, making it an environmentally responsible choice for conscientious shippers.

While paper in sheet form could possibly be used as a protective packaging material, i is usually preferable to convert the sheets of paper into a relatively low density pad-like cushioning or dunnage product. This conversion may be accomplished by a cushioning conversion machine, such as that disclosed in commonly assigned U.S. Pat. No. 5,123,889. The conversion machine disclosed in U. S. Pat. No. 5,123,889 converts sheet-like stock material, such as paper in multi-ply form, into relatively low density pads. Specifically, the machine converts this stock material into a continuous unconnected strip having lateral pillow-like portions separated by a thin central band. This strip is connected as by coining along its central band to form a coined strip which is cut into sections, or pads, of a desired length. The stock material preferably consists of three superimposed webs or layers of biodegradable, recyclable and reusable thirty-pound Kraft paper rolled onto a hollow cylindrical tube.

Conversion machines, like the one shown in U.S. Pat. No. 5,123,889, heretofore have used a freely rotating roll from which the stock material to be converted is fed by means of the same mechanism that advances the material through the machine. Specifically, a pair of gears that perform a connecting operation have been used to advance the material being converted. These gears stop and start their rotation during the conversion process, and this results in the need to accelerate the stock roll every time the gears start, with resulting changes in the tension of material being fed through the conversion machine. These changes in the tension of the material can affect the quality of the dunnage product being produced.

Also, when the conversion process is stopped, the rotational inertia of the stock roll can cause the stock roll to overrun and form a loose loop of material at the supply end of the conversion machine. When the conversion process is resumed, initially the material will be at a relatively low tension until the loose loop of material is taken up, at which point the tension on the paper will rapidly increase, almost instantaneously, to a relatively high level until the stock roll accelerates to match the feed rate through the machine. This quick change in tension can cause the material to tear, as well as degrade the quality of the dunnage product being produced.

Heretofore, a dancer (damper) roller has been used as a simple means to dampen the effects of starting and stopping the stock material feed mechanism and thereby attempt to maintain a more uniform tension on the stock material. In one arrangement, a dancer roller is mounted between a pair of pivot arms pivotally attached to stock roll support structure mounted to the rear end of the conversion machine's frame. Although beneficial, proper functioning of the dancer roller is sensitive to the orientation of the machine. Conversion machines like the one shown in U.S. Pat. No. 5,123,889 have been mounted to stands for rotation about a horizontal axis generally from a vertical orientation to a horizontal orientation or beyond horizontal orientation. The dancer roller may function as desired when the machine is oriented horizontally, but not when the machine is oriented vertically. This presents a problem in that tension control cannot be readily obtained by the use of a damper roller or the like while accommodating different machine orientations ranging from vertical to horizontal and beyond.

SUMMARY OF THE INVENTION

The present invention provides a cushioning conversion system and method wherein a dancer roller is uniquely employed to eliminate one or more problems associated with prior art conversion systems and methods. The system advantageously uses the dancer roller to help maintain a greater uniformity of tension on the sheet material being fed through conversion assemblies of a cushioning conversion machine from changes in loads acting on the sheet material upstream of the dancer roller, regardless of the orientation of the conversion machine. That is, the invention enables tension control while permitting the angular orientation of the conversion machine to be varied as from a vertical orientation to a horizontal orientation, and preferably through a range of at least 90 degrees and more preferably through a range of at least or about 135 degrees. One or more features of the invention may also be used advantageously in systems which do not provide for angular adjustment of the conversion machine.

According to a particular aspect of the invention, a cushioning conversion system and method for converting sheet stock material into a relatively low density cushioning dunnage product comprise the use of a cushioning conversion machine including conversion assemblies which convert the sheet material into the cushioning dunnage product and a stock roll cart for supporting a supply of sheet stock material. The stock roll cart includes a dancer roller assembly for helping to maintain a greater uniformity of tension on the sheet material being fed through the conversion assemblies. In the preferred embodiment, the functioning of the dancer roller as a damping device is independent of the orientation of the conversion machine within a wide range preferably extending form vertical to horizontal, and beyond.

According to one specific embodiment of the invention, the stock roll cart (forming a part of the system and used to carry out the method of the invention) preferably includes a loop roller and the dancer roller assembly includes a cooperating dancer roller mounted at a distal end of a pivot arm for moving the dancer roller through a range of rotational movement. In another specific embodiment, the dancer roller assembly includes a dancer roller cooperating with a loop roller, and a guideway for linearly guiding the dancer roller through a range of linear movement. In either embodiment, there preferably is provided on the stock roll cart a low level detector which detects a low level condition of the supply of sheet stock material. In response to detection of a low level condition by the low level detector, an indicator provides an audible or visible notification of the low level condition.

As is particularly preferred, the sheet stock material, which preferably is supplied in roll form, is biodegradable, recyclable, and composed of a renewable resource.

The system also preferably includes a stand for holding the cushioning conversion machine at an elevated position. A preferred form of stand includes vertical supports to which the machine is mounted and base portions adjacent bottom ends of the vertical supports, each base portion extending in a substantially horizontal plane parallel to another base portion. Ideally, the cart is adapted to be received in a delivery position between the base portions of the stand.

The stand also preferably is configured to provide for adjustment of the angular orientation of the machine, preferably at least between a horizontal position and a vertical position, if not through a greater range of angular adjustment.

The present invention provides the foregoing and other features hereinafter fully described and particularly pointed out in the claims, the following description and annexed drawings setting forth in detail a certain illustrative embodiment of the invention, this embodiment being indicative, however, of but one of the various ways in which the principles of the invention may be employed.

DETAILED DESCRIPTION

Figure 1:
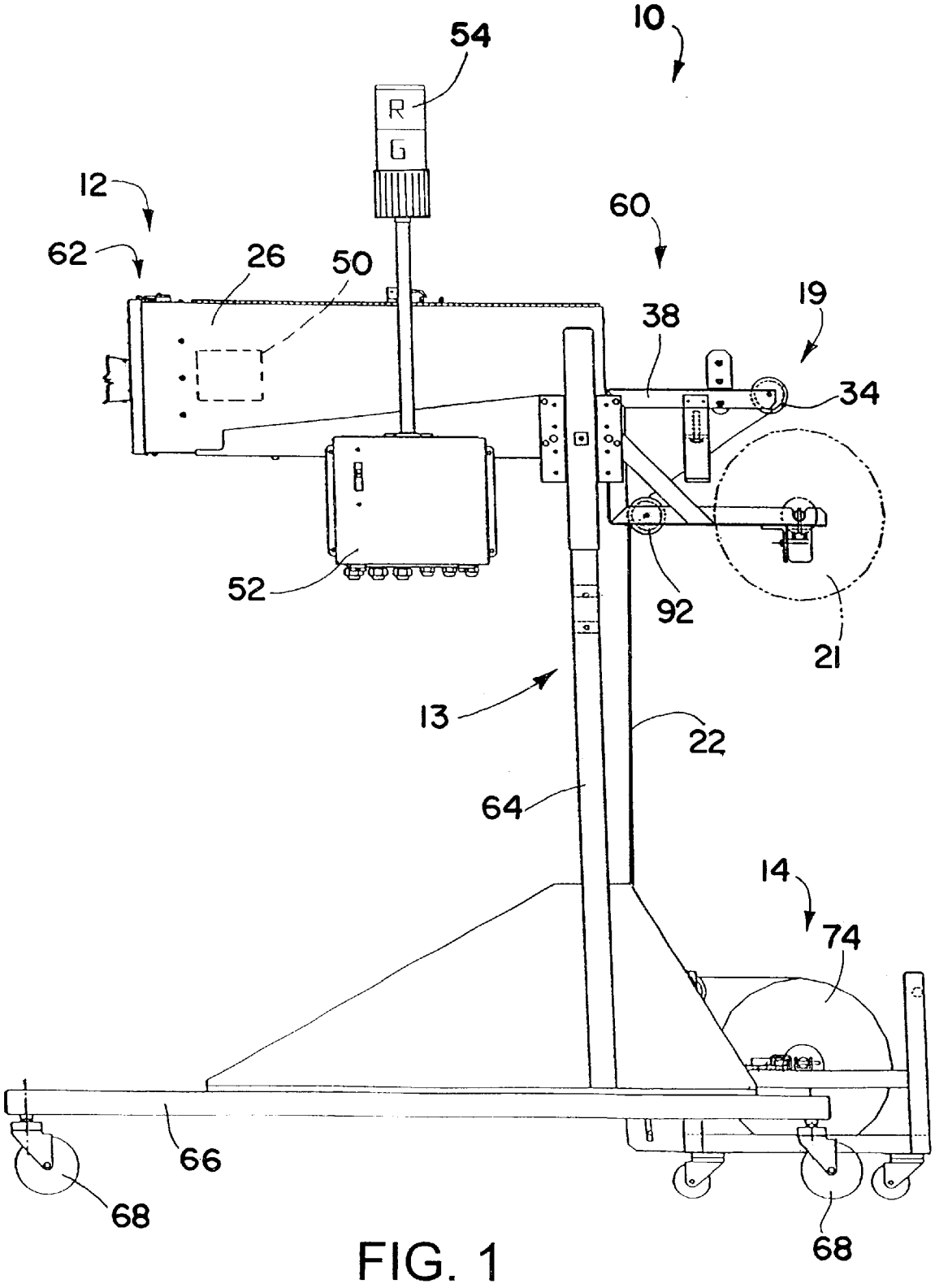
FIG. 1 is a side view of a cushioning conversion system according to one embodiment of the present invention.

Referring now to the drawings in detail and initially to FIGS. 1–4, a preferred embodiment of a cushioning conversion system 10 according to the present invention is shown. The system 10 generally comprises a cushioning conversion machine 12 for producing dunnage pads from sheet stock material, a stand 13 for supporting the machine 12, and a cart 14 for supporting a supply of sheet stock material that is payed into the machine for conversion into a relatively low density cushioning dunnage product or pad.

Figure 2:
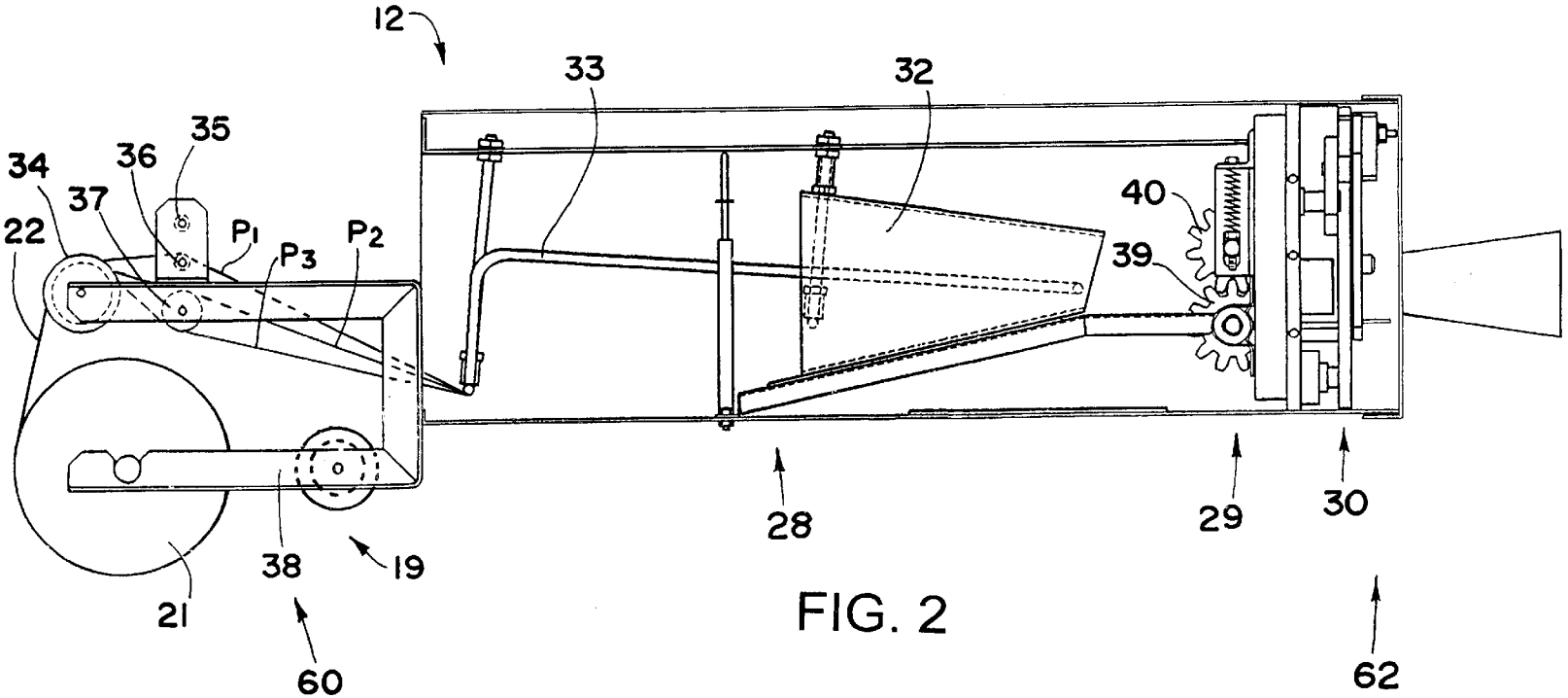
FIG. 2 is a side view of a cushioning conversion machine which may be used in the system according to the present invention, with the nearest wall of the machine's housing removed to show the conversion assemblies therein.

As shown in FIGS. 1 and 2, the conversion machine 12 has a stock supply which, in the illustrated embodiment, includes an integral stock roll holder assembly 19 for supporting a roll 21 of sheet stock material 22. The stock material 22 preferably consists of one or more, typically two or three, superimposed plies $P_1$, $P_2$ and $P_3$ of biodegradable, recyclable and reusable sheet material, such as Kraft paper rolled onto a hollow cylindrical tube. The machine 12 converts this stock material 22 into a crumpled strip of cushioning/dunnage (not shown) having inwardly folded edge portions interconnected to maintain the cushioning integrity of the cushioning strip. The machine 12 also has provision for severing, as by cutting, the strip to form a discrete pad of desired length, as is further discussed below.

The machine 12 generally comprises a housing 26 and cushion-producing (conversion) assemblies which are mounted in the housing 26 and which form the pads. The cushion-producing assemblies of the illustrated conversion machine include a forming assembly 28, a feed/connecting assembly 29, and a severing assembly 30, all of which are mounted in or to the housing 26. The illustrated forming assembly 28 includes a shaping chute 32 and a forming member 33 for forming the sheet material into a relatively thicker three-dimensional strip that is then connected by the feed/connecting assembly 29 to form the cushioning strip that is cut to length by the severing assembly 30.

During operation of the machine 12, the stock material 22 is payed off of the stock roll 21 and travels over a constant entry roller 34. After passage over the constant entry roller, the plies $P_1$, $P_2$ and $P_3$ are separated for passage between or around separators 35–37. The constant entry roller and separators are mounted between brackets 38 attached to the rear end of the housing 26. For further details of the constant entry roller and separators, reference may be had to U.S. Pat. No. 5,123,889. In the illustrated embodiment, the brackets 38 are U-shaped with the base thereof attached to the machine housing, the upper legs thereof supporting the constant entry roller 34 and separators 35, 36, 37 and the lower legs thereof forming the stock roll holder assembly 19.

From the separators 35–37, the separated plies $P_1$, $P_2$ and $P_3$ pass to the forming assembly 28. The forming assembly causes inward folding of the lateral edges of the sheet stock material 22 to form a continuous strip having lateral pillow portions and a thinner central band portion. The feed/connecting assembly 29, which in the illustrated embodiment includes a pair of cooperating gear-like members 39 and 40, pulls the stock material 22 downstream through the machine and also connects the layers along the central band, as by coining and/or perforating in the illustrated preferred embodiment, to form a connected strip. As the connected cushioning strip travels downstream from the feed assembly 29, the severing assembly 30 cuts the strip into pads of a desired length. For further details of the illustrated and similar cushion-producing machines, reference may be had to U.S. Pat. No. 5,123,889 and published PCT application Ser. No. US96/09109.

The production of dunnage pads by the illustrated machine 12 is controlled by a controller (diagrammatically shown at 50) usually provided in the housing 26 or in a remote unit. For details of the operation of the controller 50, reference may be had to U.S. Pat. Nos. 4,619,635 and 5,571,067 and to published PCT application Ser. No. PCT/US95/09275, which are hereby incorporated herein by reference in their entireties.

An exemplary pad produced by the illustrated machine 12 comprises the one or more plies of sheet material that have side portions thereof folded over the center portions thereof to form laterally spaced-apart pillow portions extending along the length of the pad. The pillow portions are separated by a central band where lateral edge portions are brought together. The lateral edge portions, which may be overlapped and/or interleaved, are connected together, and/or to underlying center portions of the plies along the central band. In a preferred form of cushioning pad, the connecting is accomplished by a combination of coining and stitching, the stitching being effected by perforations and/or cut tabs disposed along the central band. However, it will be appreciated by those skilled in the art that other types of conversion machines may be used to produce the same or other forms of cushioning strips. For further details of an exemplary pad, reference may be had to published PCT application Ser. No. US96/09109, which is hereby incorporated herein by reference in its entirety.

The housing 26 of the conversion machine 12 has a longitudinal axis corresponding to the direction of passage of the sheet material downstream through the conversion assemblies from a rear or upstream end 60 to a front or downstream end 62 of the machine. The housing is generally rectangular in cross-section taken transverse to the longitudinal axis of the machine. The machine 12 may be supported in any suitable manner, for example by the stand 13.

In the illustrated embodiment, the cushioning conversion machine 12 is adjustably supported at a convenient height by the stand 13. The stand includes square-shaped tubular posts or uprights (vertical frame members) 64 for mounting the machine that are laterally spaced apart and extend upwardly from laterally spaced apart frame elements or beams (base frame members) 66. Although not shown, the frame elements 64 and 66 are joined together by appropriately located cross frame members. If desired, the frame 13 may be equipped with casters 68 (or other wheels) for moving the system from one location to another. The casters 68 are positioned to provide four-point stable support for the cushioning conversion system 10. For further details of the frame and the manner in which the machine may be adjustably mounted thereto, reference may had to U.S. Pat. No. 5,123,889 and U.S. patent application Ser. No. 08/194,143, both of which are hereby incorporated herein by reference in their entireties. Rear portions of the laterally spaced apart base members 66 of the stand 13 preferably are adapted to receive the stock roll cart 14 therebetween.

Figure 3:
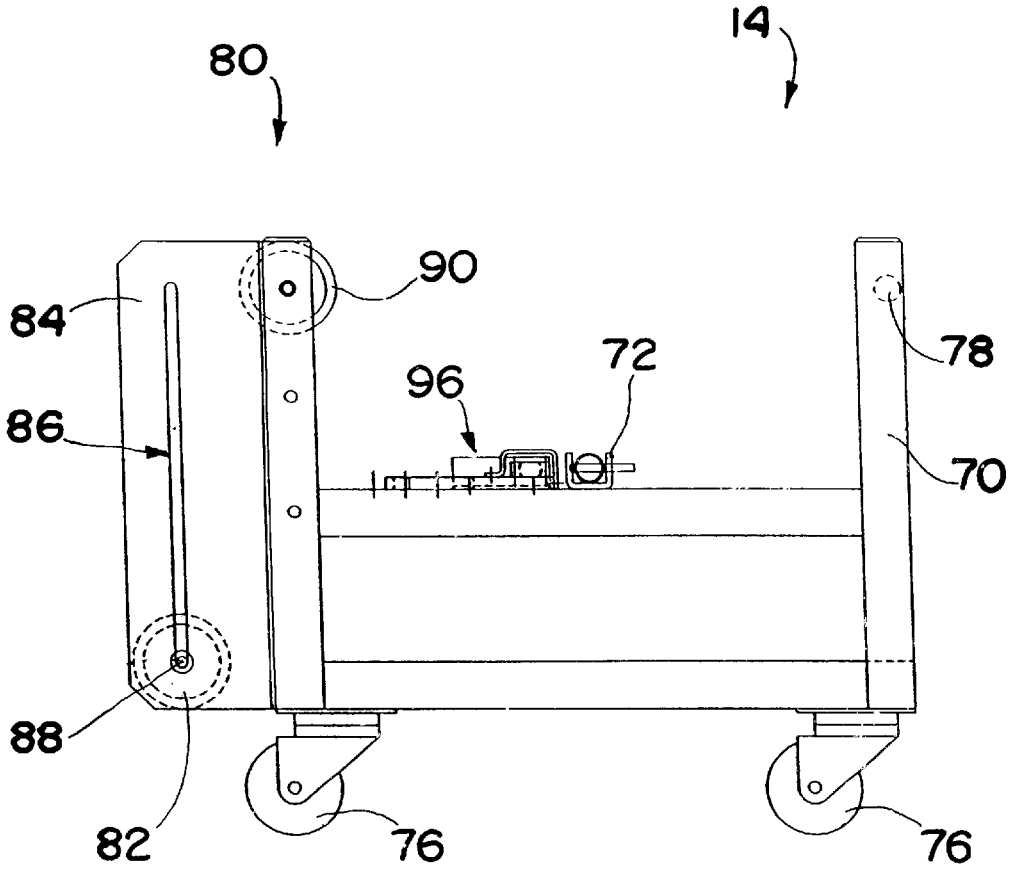
FIG. 3 is an enlarged side view of a stock roll cart used in the system shown in FIG. 1.
Figure 4:
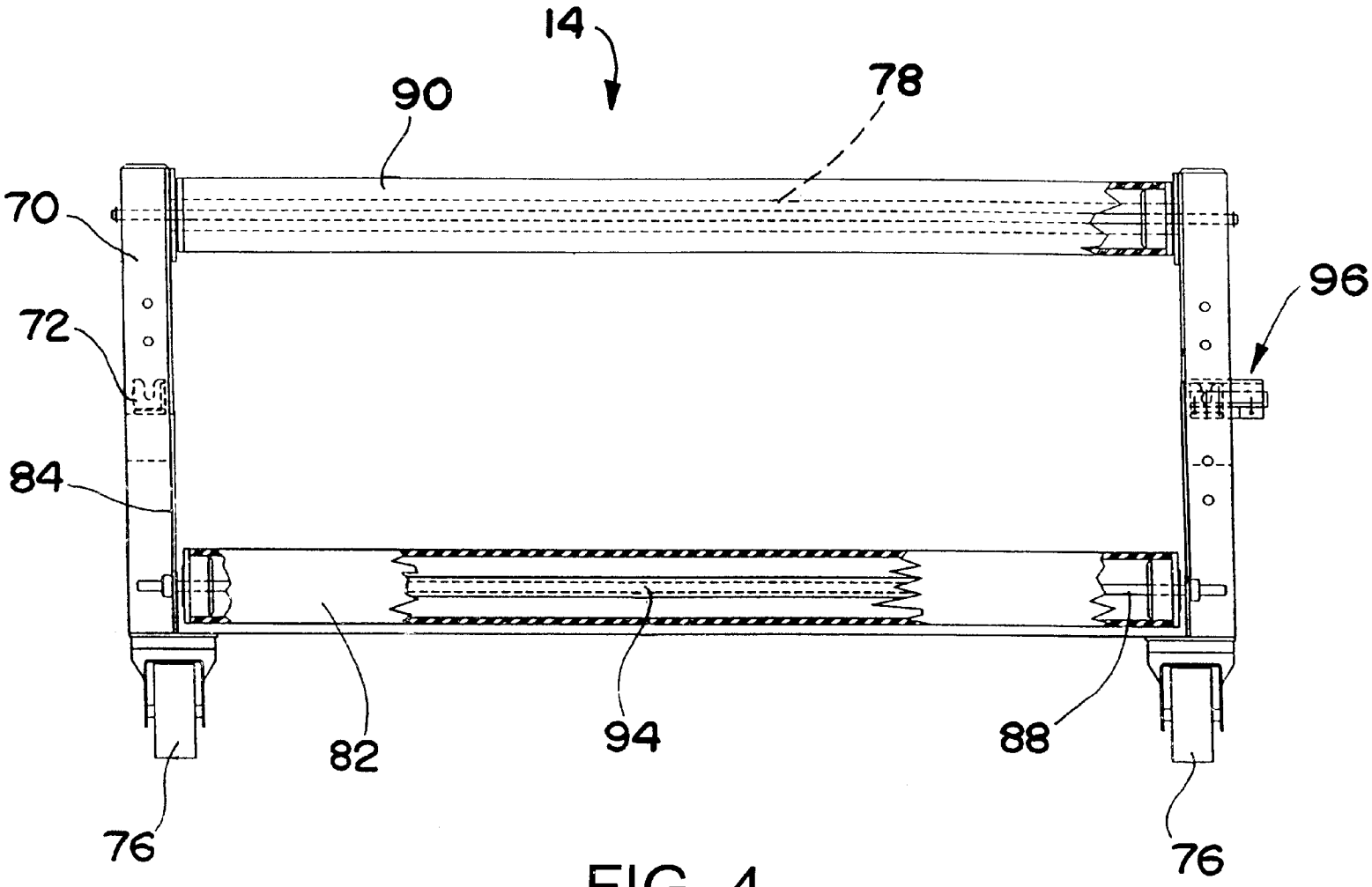
FIG. 4 is a front view of the stock roll cart shown in FIG. 3.

As shown in FIGS. 1, 3 and 4, the stock roll cart 14 according to the first embodiment of the invention includes a frame 70, stock roll support brackets (cradles) 72 attached to the frame for rotatably mounting a stock roll 74 thereon, and wheels or casters 76 mounted to the bottom of the frame for facilitating movement of the cart into a delivery position adjacent the stand 13. Preferably, at least one pair of wheels on the cart are pivotable about a vertical axis to facilitate maneuvering the cart into the delivery position. The frame 70 also preferably includes a handle 78 for readily moving the cart into the delivery position for supplying the sheet material 22 to the cushioning conversion machine 12. For further details of an exemplary stock roll cart, reference may had to U.S. Pat. Nos. 4,557,716; 4,650,456; and 5,637,071, which are hereby incorporated herein by reference in their entireties. Although the cart preferably is readily movable as by rolling from place to place, it will be appreciated that the cart may simply be equipped as with feet for stationary resting on the floor adjacent the conversion machine.

A stock roll cart is advantageous in facilitating use of a considerably larger roll of stock material and thus less frequent downtime for maintenance of the system 10. Not only is lifting a larger stock roll up to the brackets 38 on the cushioning conversion machine 12 more difficult, but the addition of a stock roll to the stock roll holder assembly 19 on the machine changes the center of gravity of the system. A cart facilitates loading a larger stock roll because the stock roll does not have to be lifted as far and because the cart can be moved to a remote location for loading and then returned to the machine 12. A second cart advantageously could be provided so that the second stock cart could be loaded and available for quick replacement of the original stock cart as the sheet material loaded thereon is depleted.

The stock roll cart 14 according to the present invention includes an integral dancer roller assembly 80 for helping to maintain a more uniform tension in the sheet stock material 22 (FIG. 2) as it is payed off the stock roll 74. The dancer roller assembly 80 includes a dancer roller 82 movably mounted between laterally spaced apart guide members 84 connected to the frame 70 of the cart 14. The guide members 84 have vertical guideways 86 formed therein for guiding the motion of the dancer roller 82. The dancer roller rotates about an axle 88 whose ends slidingly engage the guideways.

The dancer roller 82, on axle 88, rides up and down in the guideways 86 as tension on the sheet material 22 increases or decreases, respectively, during unwinding of the sheet material from the stock roll 74. This movement dampens the effects of starting and stopping the feed/connecting assembly 29 of the cushioning conversion machine 12 and thereby assists in maintaining a more uniform and consistent tension on the sheet material. Moreover, such dampening effect will occur for the most part independently of the orientation of the conversion machine. By decoupling the dancer roll from the machine, the conversion machine may be oriented vertically, horizontally or sloped relative to vertical and horizontal without adversely affecting the damping effect of the dancer roller.

The dancer roller assembly 80 preferably includes a loop roller 90 rotatably mounted to the cart 14. A guide roller 92 is preferably joumalled between the brackets 38 described above in connection with the cushioning conversion machine 12. The loop roller 90 cooperates with the dancer roller 82 and the guide roller 92 to form a loop in the sheet material that engages the dancer roller as the sheet material is trained around the dancer roller on its way to the guide roller and the constant entry roller 34. The guide roller 92 keeps the stock material close to the vertical supports 64 of the stand 13 and out of the way. Also, the arrangement of the rollers ensure proper wrapping of the stock material around the rollers over which it is trained for desired control of the stock material being fed into the conversion machine.

The dancer roller 82 preferably is biased simply by gravity to exert a tensioning force on the sheet material 22 being fed into the machine 12. Thus the dancer roller applies a substantially constant force to the sheet material at the loop irrespective of the position of the dancer roller within its range of travel, which in this embodiment is defined by the guideways 86. Although the dancer roller is biased by gravity in the illustrated preferred embodiment, alternative or additional biasing means may be used, such as a resilient spring biasing means.

A vertical guideway 86 is advantageous in maximizing the gravitational forces on the dancer roller 82 and thus on the sheet material 22. To further enhance the operation of the dancer roller, additional weight or ballast may be added thereto. FIG. 4 illustrates the dancer roller 82 partially broken away to show a ballast rod 94 added to the axle 88 at the center or core of the dancer roller. Preferably, the moving dancer roller, including its outer casing, the ballast rod, axle and associated hardware, should weigh between about 1 and 10 pounds, more preferably between about 3 and 7 pounds, and more preferably about 5 pounds. The weight preferably is added to the center or core of the dancer roller to maximize the beneficial effects of the additional weight while minimizing an increase in rotational inertia which could cause the surface of the dancer roller to move at a speed that is either faster or slower than that of the sheet material. Preferably the ballast weight is changed to accommodate different paper bias weights, stock roll weights and/or stock roll sizes, as well as the machine's angular orientation. The ballast weight provides an easy way to readily vary the weight of the dancer roller for different applications/situations.

As the machine 12 operates, the dancer roller 82 engages the sheet material and rotates with the passage thereof. A faster surface speed could cause the stock roll 74 to overfeed, thus creating slack in the sheet material and excessively reducing the tension in the sheet material. On the other hand, a slower surface speed of the dancer roller could retard the advance of the sheet material and thereby undesirably increase the tension in the sheet material.

During steady state operation, an equilibrium would be reached with a constant tension on the sheet material, and the dancer roller 82 will rotate in a substantially fixed location, moving slightly up or down with varying thickness or other variables in the quality of the sheet material 22. In actual operation, however, the system 10 will not operate in a steady state. The cushioning conversion machine 12 operates in a stop and start fashion, and so the dancer roller 82 will oscillate to some extent. With a new stock roll, the force required to overcome the inertia of the stock roll may lead to the stock roll overrunning slightly when the machine stops. The dancer roller takes up the slack by pushing down on the loop in the sheet material. As the machine starts, the tension in the sheet material increases suddenly. To prevent tearing of the sheet material the dancer roller yields and rises up. Thus the rise and fall of the dancer roller follows the web tension changes caused by the stop and start action of the cushioning conversion machine.

A brake (not shown) or other suitable device may be used to provide a constant drag on the sheet material 22 being supplied to the machine 12 from a supply source such as the stock roll 74. The brake preferably acts on the stock roll to prevent overrunning upon stoppage of the conversion process. As an example, in order to dampen the system and keep the roll of sheet material from over running, a friction roller may be used to provide resistance to the rotation to the stock roll. Such a friction roller could have a spring biased arm, with a spring pulling the arm and the friction roller against the surface of the stock roll to provide a constant drag. Any suitable means for generating a frictional load on the roller may be used, such as a brake, for example a band brake, a drum-type brake or a caliper-type brake. The key function, as with any damped feed back controlled system, is to allow the system 10 to respond rapidly without excessive overshooting.

An optional component of the stock roll cart 14 includes a low level detector 96 for monitoring the amount of sheet material remaining on the stock roll 74. The low level detector may be connected to a further controller 52 for facilitating planned shutdown of the system 10, so as, for example, to permit splicing of a new stock roll before system 10 runs out of material. In order to indicate low level of the stock material, red light 54 will be lit. A green light may be used to indicate that the stock material is not in a low level condition.

Figure 5:
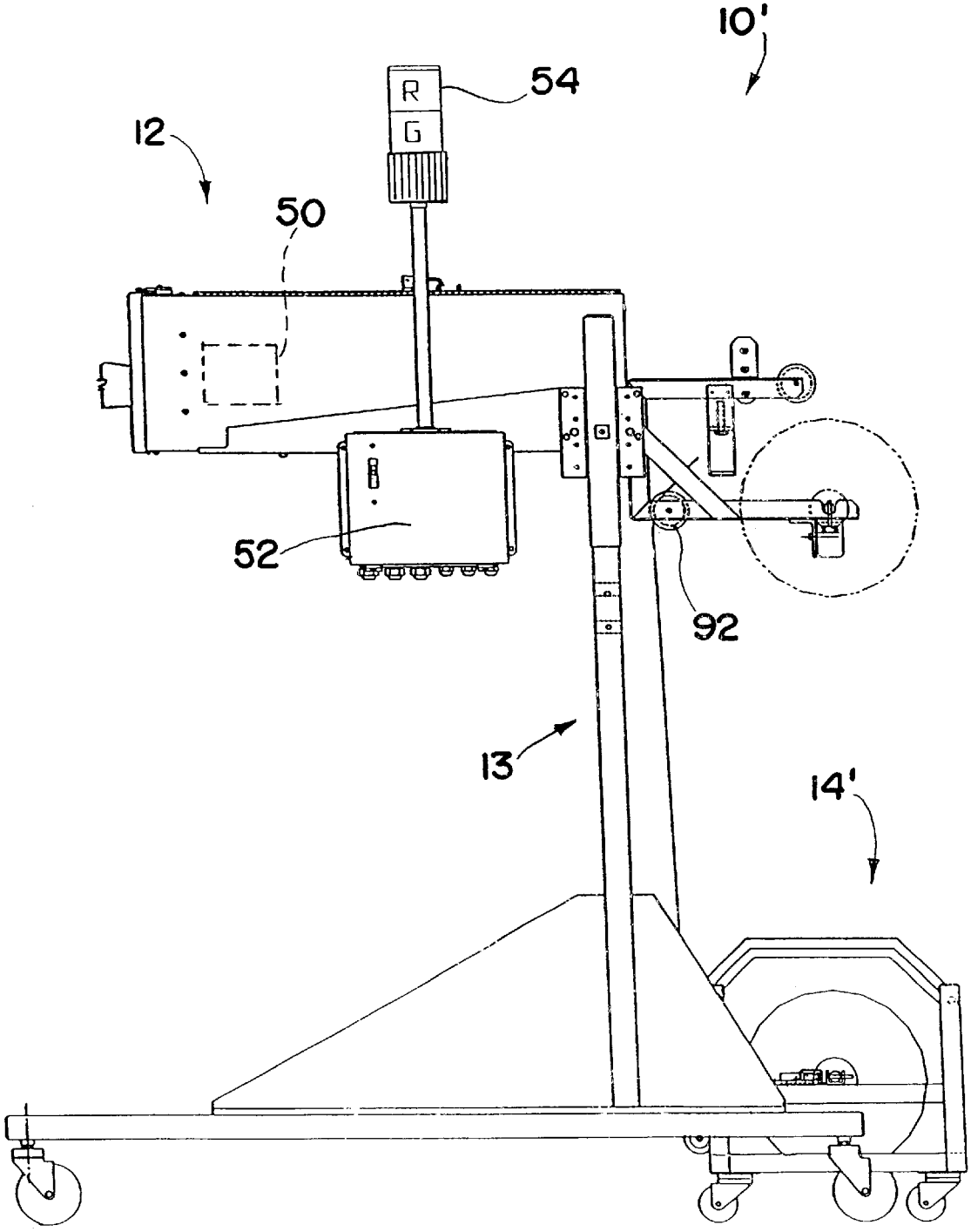
FIG. 5 is a side view of a cushioning conversion system according to another embodiment of the present invention.
Figure 6:
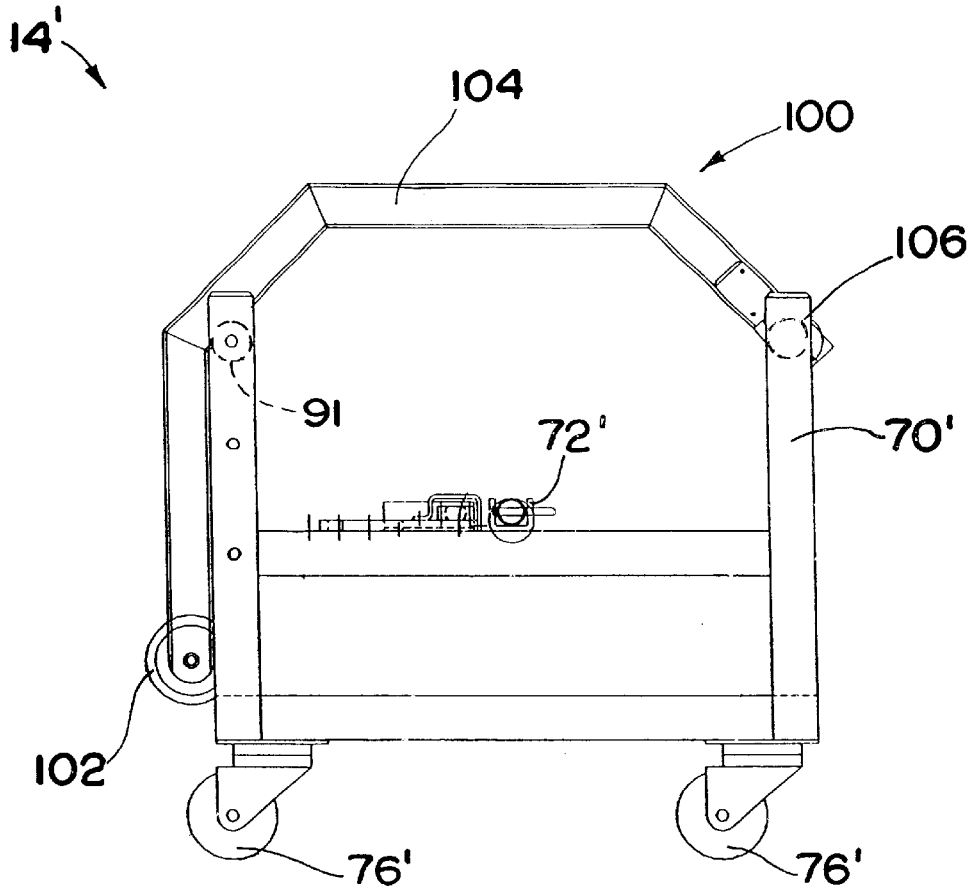
FIG. 6 is an enlarged side view of a stock roll cart used in the system shown in FIG. 5.
Figure 7:
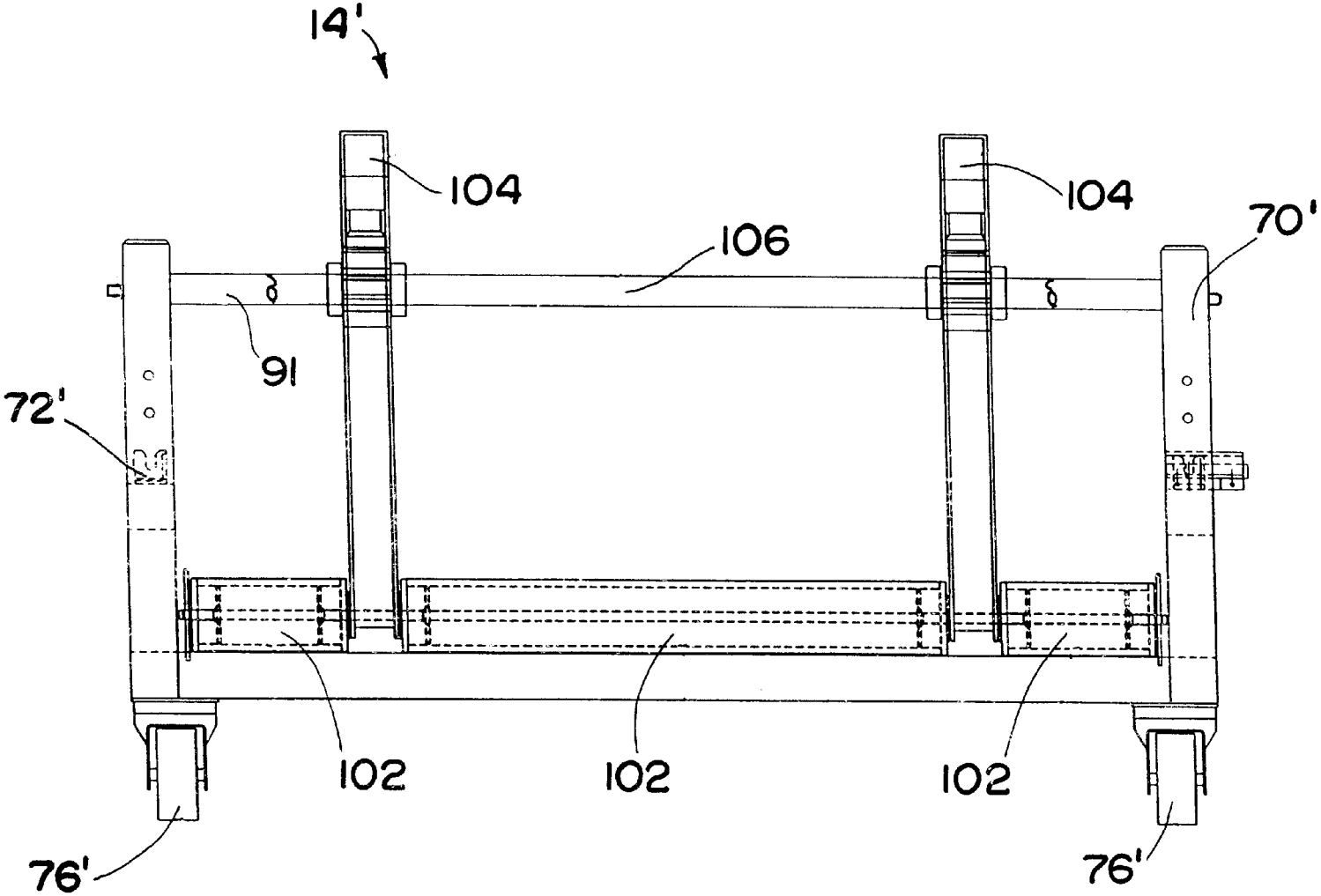
FIG. 7 is a front view of the stock roll cart shown in FIG. 6.

An alternative embodiment of the system according to the present invention is shown at 10' in FIGS. 5–7 and includes a cushioning conversion machine 12, a stand 13 and a stock roll cart 14'. The cushioning conversion machine 12 and the stand 13 are the same as those described above. The stock roll cart 14' includes a frame 70', stock roll mounts 72', and wheels 76' similar in construction to those of the corresponding elements on the stock roll cart of the first embodiment (FIGS. 1–4). However, the stock roll cart 14' of this alternative embodiment includes an alternative dancer roller assembly 100 having a dancer roller 102 movable through an arcuate range of motion.

The dancer roller assembly 100 shown in FIGS. 5–7 includes a segmented dancer roller 102. The segmented dancer roller is rotatably supported on the distal ends of a pair of arcuate swing arms 104 whose proximate ends are pivotally mounted to the rear of the frame 70 of the cart 14 at a pivot formed by a pivot rod 106. The sheet material 22 is trained around a unitary loop roller 91 and around the dancer roller 102 to the guide roller 92, as described above. As the tension in the sheet material increases, the dancer roller rotates with the swing arms 104 about the pivot rod 106 in a generally upward direction. Thus the dancer roller moves in an arc rather than a straight line. As a result, the force applied by the dancer roller varies with the angle of rotation of the dancer roller about the pivot rod.

The distance between the pivot rod 106 and the dancer roller 102 is as large as possible to approximate linear movement of the dancer roller as the swing arms 104 rotate, thus providing a more consistent force on the sheet material. As shown in FIG. 6, the pivot rod 106 and the dancer roller 102 interpose therebetween a vertical line through the center of the stock roll 74. In other words, the pivot and the dancer roller are located on opposite sides of the stock roll. This enables the swing arms to be longer and thus improves the linearity of the path the dancer roller follows.

In summary, the present invention clearly provides cushioning conversion systems 10 and 10' for converting sheet stock material into a relatively low density cushioning product each system 10 and 10' using a dancer roller for maintaining the tension in the sheet material at a constant tension or at a tension that does not exceed a predetermined limit, thereby forming a higher quality cushioning product with fewer of the problems experienced in prior art cushioning producing systems.

Although the invention has been shown and described with respect to a certain preferred embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application.

What is claimed is:

1. A cushioning conversion system for converting sheet stock material into a relatively low density cushioning dunnage product, comprising:

a cushioning conversion machine including conversion assemblies which convert the sheet material into the cushioning dunnage product and a stock roll cart for supporting a supply of sheet stock material, the stock roll cart including a dancer roller assembly for helping to maintain a greater uniformity of tension on the sheet material being fed through the conversion assemblies.

2. A system as set forth in claim 1, wherein the conversion assemblies form a relatively low density cushioning dunnage product having lateral pillow portions and a central connecting portion.

3. A system as set forth in claim 1, including a loop roller and wherein the dancer roller assembly includes a cooperating dancer roller mounted at a distal end of a pivot arm for moving the dancer roller through a range of rotational movement.

4. A system as set forth in claim 3, wherein the stock roll cart includes a low level detector which detects a low level condition of the supply of sheet stock material.

5. A system as set forth in claim 4, further comprising an indicator which provides an audible or visible notification of the low level condition in response to detection by said low level detector.

6. A system as set forth in claim 1 including a loop roller and wherein the dancer roller assembly includes a cooperating dancer roller, and a guideway for linearly guiding the dancer roller through a range of linear movement.

7. A system as set forth in claim 6, wherein the stock roll cart includes a low level detector which detects a low level condition of the supply of sheet stock material.

8. A system as set forth in claim 7, further comprising an indicator which provides an audible or visible notification of the low level condition in response to detection by said low level detector.

9. A system as set forth in claim 1, wherein the sheet stock material is supplied in roll form.

10. A system as set forth in claim 9, wherein the sheet stock material is biodegradable, recyclable, and composed of a renewable resource.

11. A system as set forth in claim 1, further comprising a stand for holding the cushioning conversion machine at an elevated position, the stand including vertical supports to which the machine is mounted and base portions adjacent bottom ends of the vertical supports, each base portion extending in a substantially horizontal plane parallel to another base portion.

12. A system as set forth in claim 11, wherein the cart is adapted to be received in a delivery position between parallel base portions of the stand.

13. A system as set forth in claim 11, wherein an angular orientation of the machine is adjustable from an at least horizontal position to an at least vertical position.

14. A system as set forth in claim 1, further comprising at least one guide roller for guiding the sheet stock material, the dancer roller assembly including a dancer roller, the guide roller guiding the sheet material between the dancer roller and the cushioning conversion machine.

15. A method of supplying sheet stock material to a cushioning conversion system including a cushioning conversion machine having conversion assemblies for converting the sheet stock material into a relatively lower density cushioning dunnage product and a stock roll cart for supporting a supply of sheet stock material, the stock roll cart including a dancer roller assembly having a dancer roller for helping to maintain a greater uniformity of tension on the sheet material being fed through the conversion assemblies, the method comprising the step of:

passing a loop of sheet material through the dancer roller assembly to the cushioning conversion machine for conversion to a cushioning dunnage product such that the dancer roller applies a substantially constant force to the sheet material through a range of motion of the dancer roller.

16. A method as set forth in claim 15, further comprising the step of converting the sheet stock material to a relatively less dense cushioning dunnage product having lateral pillow portions and a central connecting portion.

17. A method as set forth in claim 15, wherein the passing step includes passing the sheet material through a dancer roller assembly having a pivot arm for moving the dancer roller through a range of rotational movement.

18. A method as set forth in claim 17, further comprising the step of positioning the cart in a delivery location for supplying sheet material to the cushioning conversion machine.

19. A method as set forth in claim 15, wherein the passing step includes passing the sheet material through a dancer roller assembly having a guideway for guiding the dancer roller through a range of linear movement.

20. A method as set forth in claim 15, further comprising the positioning of the cart in a delivery positioning for supplying sheet material to the cushioning conversion machine.

21. A method as set forth in claim 15, wherein the passing step includes passing a sheet material which is biodegradable, recyclable, and composed of a renewable resource.

22. A method as set forth in claim 15, wherein the passing step includes passing the sheet material through at least one guide roller between the dancer roller and the cushioning conversion machine.

23. A method as set forth in claim 15, further comprising the step of adjusting the height of the cushioning conversion machine, wherein the cushioning conversion machine is mounted on a stand having vertical supports.

24. A method as set forth in claim 15, including the step of adjusting an angular orientation of the machine about a horizontal axis.

25. A system as set forth in claim 1, wherein the dancer roller assembly has a guideway for guiding a dancer roller through a range of linear movement.

26. A system as set forth in claim 1, wherein the dancer roller assembly includes a dancer roller having a ballast rod which is removable to vary the weight of the dancer roller.

27. A system as set forth in claim 26, wherein the dancer roller weighs between about 1 and about 10 pounds.

28. A system as set forth in claim 27, wherein the dancer roller weighs between about 3 and 7 pounds.

29. A system as set forth in claim 28, wherein the dancer roller weighs about 5 pounds.

30. A system as set forth in claim 3, wherein the pivot arm pivots about a pivot axis, and the supply of sheet stock material is located between the pivot axis and the dancer roller.

* * * * *